United States Patent [19]

Mangum

[11] 4,387,898

[45] Jun. 14, 1983

[54] BALL GAME APPARATUS AND METHOD

[76] Inventor: U. Stancel Mangum, 838 E. 6600 South, Murray, Utah 84107

[21] Appl. No.: 287,868

[22] Filed: Jul. 28, 1981

[51] Int. Cl.[3] ..... A63B 71/02; A63B 59/02; A63B 63/04

[52] U.S. Cl. ..... 273/411; 273/1.5 R; 273/326; 273/375; 273/400

[58] Field of Search ..... 273/411, 1.5 R, 1.5 A, 273/318, 322, 323, 326, 371, 374, 375, 382, 398, 400, 402; 180/214; 280/270

[56] References Cited

U.S. PATENT DOCUMENTS

| | | | |
|---|---|---|---|
| 2,468,801 | 5/1949 | Beall | 180/214 |
| 2,534,067 | 12/1950 | Rubin | 273/1.5 R |
| 3,205,618 | 9/1965 | Heytow | 273/86 B X |
| 3,880,427 | 4/1975 | Bingham | 273/411 X |

FOREIGN PATENT DOCUMENTS

| | | | |
|---|---|---|---|
| 830164 | 3/1960 | United Kingdom | 273/326 |

OTHER PUBLICATIONS

"Wheelie Basketball", *Washington Post,* Apr. 1, 1976; pp. D1, D3.

*The Sporting Goods Dealer,* Feb. 1979, p. 132; "Standards Feature Optional Ref Stand".

*Primary Examiner*—William H. Grieb

*Attorney, Agent, or Firm*—Thorpe, North & Western

[57] ABSTRACT

A ball game includes a generally horizontal playing floor on which vehicles of two different teams are operated by players. Each vehicle includes wheels for supporting the vehicle on the floor, and for guiding the vehicle, a power source for causing the vehicle to move, a seat on which a player sits, and a crank-like steering mechanism to enable the player to guide the vehicle. Positioned at opposite ends of the playing floor and above the floor are targets which, when struck by a ball, produce a visual or audible signal. The game includes a ball and each player has a scoop by which he can catch the ball or throw it to one of his teammates or toward his team's target.

14 Claims, 6 Drawing Figures

BALL GAME APPARATUS AND METHOD

BACKGROUND OF THE INVENTION

This invention relates to a game and apparatus for playing a game in which players on opposing teams ride on and steer vehicles on a playing floor and attempt, using hand held scoops, to throw a ball into contact with targets, two of which are located at opposite ends of the playing floor.

Team games have become increasingly popular in recent years with various organizations sponsoring team play in such activities as softball, basketball, socker, bowling, etc. Such games stimulate comradery among team players, exercise, and generally allow participant recreation.

Most of the above-identified team games have been known for many years even though the popularity of the games, from the standpoint of sponsorship by the various organizations, is relatively recent. Few, if any, new team oriented games have been suggested in the past 50 years as far as this applicant is aware.

SUMMARY OF THE INVENTION

It is an object of the invention to provide a new and different game for play by two teams of players.

It is another object of the invention to provide a game in which the players ride on vehicles on a playing floor and attempt to throw a ball into contact with a target.

It is still another object of the invention to provide a game in which the vehicles may be steered with one hand by a player, leaving the other hand free to catch and throw a ball with a scoop.

The above and other objects of the invention are realized in a specific illustrative embodiment of a game which includes a generally horizontal playing floor, and at least two vehicles for operating on the playing floor by at least two players of opposite teams, each vehicle being adapted to carry and be guided by a player. Advantageously the vehicles are self propelled. First and second targets are positioned above the playing floor at opposite ends thereof, with each target including apparatus for producing some type of visual or audible signal when struck by a ball. The players utilize hand held scoops for catching and throwing the ball, each scoop including a handle by which the scoop is held, and a cup for receiving and holding a ball and from which a ball may be thrown. Also included is a ball for use by the players in striking the targets.

The object of the game is for each team to throw the ball at its respective target to score points. Advantageously, the vehicles are maneuvered toward the target and the ball is passed to players in the best position to throw the ball at the target. The opposing team players attempt to block the movement of the vehicles and the throwing of the ball toward the target until they can gain possession of the ball and attempt to score themselves.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
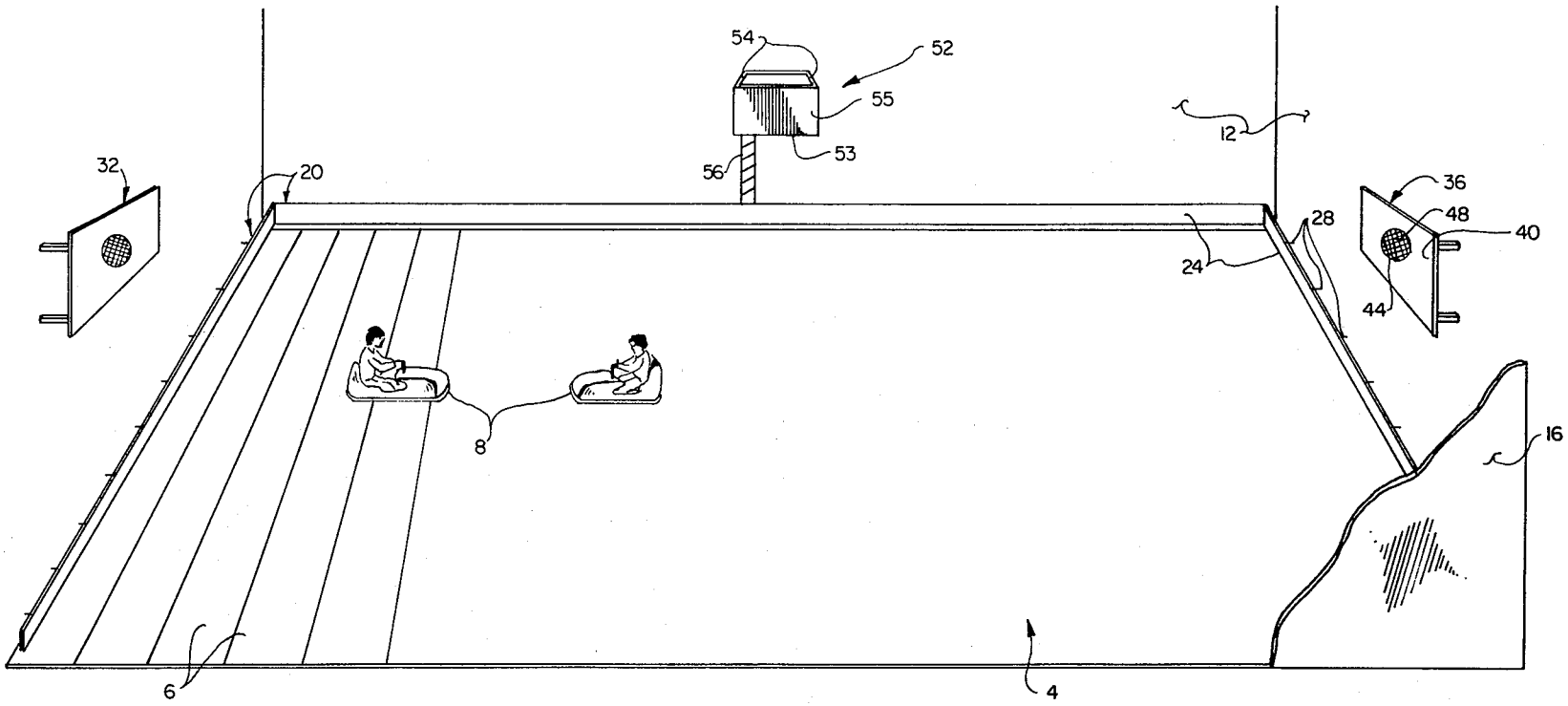
FIG. 1 is a perspective view of game apparatus made in accordance with the principles of the present invention and showing two vehicles and players.

Referring to FIG. 1 there is shown one illustrative embodiment of game apparatus of the present invention. The apparatus includes an electrically conductive, generally flat playing floor 4 oriented to be generally horizontal to allow driving thereon of vehicles 8. Illustratively, the floor may be made of transversely oriented strips of steel 6. A voltage source (not shown) supplies alternating strips 6 a certain low voltage and the remaining strips a different voltage or ground potential to thereby power vehicles 8 which are driven on the floor. This is a conventional method of powering electrical vehicles used in carnival concessions such as those known as "bumper cars". The playing floor 4 is generally rectangular, but may also be of other shapes. An illustrative floor size is 80 feet in length and 50 feet in width. An exemplary arrangement of powering the vehicles is disclosed in U.S. Pat. No. 3,205,618.

Advantageously, the playing floor 4 is enclosed by walls 12 or other barriers to prevent a playing ball (to be discussed later) from being thrown from the playing area. For example, three sides of the playing floor 4 could be circumscribed by walls, with a fourth side being provided with a wire or glass screen 16 to prevent the playing ball from leaving the floor while also allowing spectators to view the playing of the game. Of course, any number of the side walls could be transparent or otherwise arranged to allow viewing of the game therethrough. Enclosure of the playing floor is completed by provision of a ceiling.

Positioned just above the floor 4 and about the perimeter thereof are bumper guard rails 20 to prevent the vehicles 8 from striking the walls 12 and 16. The bumper guard rails include elongate strips of material 24 such as wood, hard rubber, or synthetic material of some type. The strips of material 24 are mounted to corresponding walls by resilient coil springs 28 to provide the strips of material with resiliency when struck by one of the vehicles 8. The springs 28 are simply mounted to project outwardly from the wall and then the strips of material 24 are mounted on the ends of the springs.

Mounted at opposite ends of the floor 4 are a pair of targets 32 and 36 which the players attempt to strike with the game ball. The targets will be discussed in more detail later, but briefly each target includes a generally rectangular backboard 40 mounted centrally of the end of the floor 4 and generally perpendicular thereto. An opening 44 is located in the center of the backboard 40 to provide the target into which the players attempt to throw the game ball. Positioned behind the opening 44 is a target element in the form of netting material 48 which, when contacted by a game ball, causes production of a visual or audible signal to indicate that one of the teams has scored. Each target serves a different one of the teams.

Located centrally of the side of the floor 4 and disposed above the floor is an officiating stand 52 in which a game official sits or stands during the playing of the game. A ladder 56 allows the official to climb into the box which may, illustratively, be positioned about 6 to 8 feet above the playing floor 4. Any type of structure which would support a person would be suitable. The stand 52 of FIG. 1 includes a platform 53, and waist high side walls 54 and a front wall 55.

Figure 3:
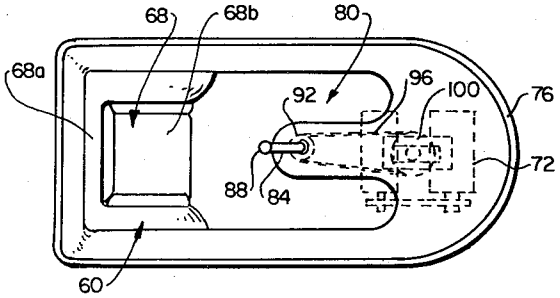
FIG. 3 is a top, plan view of the vehicle of FIG. 2.
Figure 2:
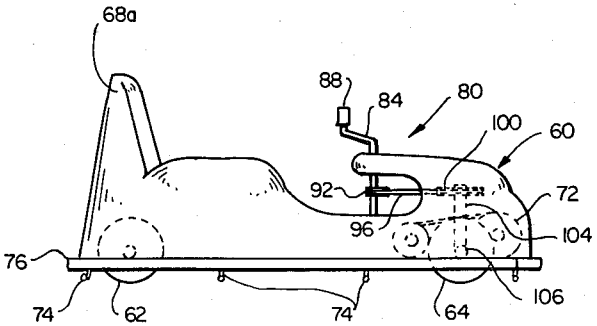
FIG. 2 is a side, elevational view of one embodiment of a vehicle which may be used with the game apparatus of FIG. 1.

An exemplary vehicle which could be used in the present game is shown in side, elevational view in FIG. 2 and top, plan view in FIG. 3. The vehicle includes a frame and shell 60 mounted to roll on a pair of rear wheels 62 and a single front wheel 64. Formed in the frame 60 is a seat section 68 on which a player may sit to drive the vehicle. The seat section 68 is positioned at the rear of the vehicle and includes an upright back support 68*a* and a bottom section 68*b* upon which a player sits. The vehicle is powered by an electric motor 72 which draws power from the floor 4 via flexible pick-up elements 74 which drag and make contact with the floor, and which is drivingly coupled to the wheel 64 to cause the vehicle to move. The motor 72 is coupled to drive the front wheel 64 in a conventional fashion by a series of pulleys and belts.

Mounted on (by adhesive, screws or other fastening means) and circumscribing the lower part of the frame 60 is a bumper guard 76 which may be made of hard rubber or other resilient material. The bumper guard 76 simply protects the vehicle from damage when the vehicle is driven into contact with the wall bumper guards 20 or with another vehicle. The elevation of the bumper guard 76 above the floor 4 is made to coincide with the elevation of the wall bumper guards 20.

The vehicle is guided by a steering mechanism 80 which consists of a crank shaft 84 mounted to be cranked or rotated in a horizontal plane. A crank handle 88 is mounted on the upper end of the crank shaft 84 for grasping by one hand of a player, with the handle being swivelable on the crank shaft. Mounted on the lower end of the crank shaft 84 is a pulley 92 which is caused to rotate when the crank shaft is rotated. The pulley 92 is coupled by way of a chain or belt 96 to another pulley 100 mounted to rotate also in the horizontal plane. The pulley 100 is coupled to a front wheel fork 104 (FIG. 2) which is caused to rotate when the pulley 100 is rotated. Wheel 64 is mounted in the fork 104 on axle 106 so that when the fork is caused to rotate, the wheel is turned to thereby guide the vehicle. The pulley 92 is smaller than pulley 100 so that one rotation of the pulley 92 will cause less than one rotation of the pulley 100 and thus of the wheels 64.

A player sitting in the seat section 68 would guide the vehicle with one hand by simply grasping the handle 88 and rotating the shaft 84 to thereby turn the wheel 64 and guide the vehicle in the desired direction. Although an exemplary vehicle for use in the game of the present invention has been described, it should be understood that a variety of vehicles, both self-propelled and player propelled (by conventional pedal and chain driven mechanisms), could be employed for the game.

Figure 4A:
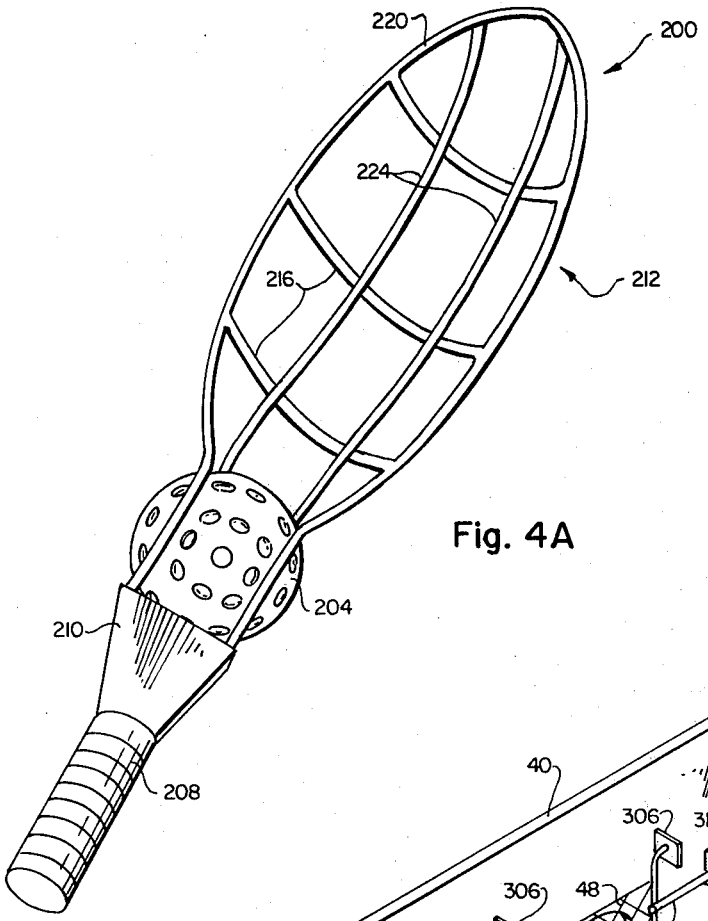
FIG. 4A is a perspective view of a scoop and ball which may be used with the game apparatus of FIG. 1.
Figure 4B:
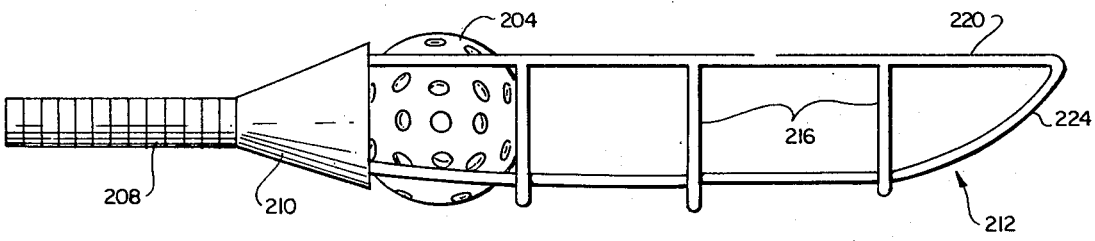
FIG. 4B is a side view of the scoop and ball of FIG. 4A.

The game apparatus also includes a scoop 200 (FIGS. 4A and 4B) for use by the players in catching and throwing the game ball 204. The game ball is of conventional design, sometimes sold under the brand name of "Whiffle Ball", and consists of a spherical hollow shell made of plastic or other resilient material having a plurality of openings spaced thereabout. The scoop 200 is also of conventional design and includes a handle 208 by which a player holds the scoop, a coupling section 210, and a cup portion 212 formed of a plurality of ribs 216, 220 and 224 joined together as shown. A perimeter rib 220 is formed in the shape of an oval, with a narrowed portion joined to the coupling section 210. A pair of longitudinal ribs 224 extend from the top of the perimeter rib 220 toward the section 210 and is joined thereto. Transverse ribs 216 join the longitudinal ribs 224 together and to the perimeter rib 220 to form a cup like structure. The longitudinal ribs 224 and the narrowed part of the perimeter rib 220 form a pocket into which the ball 204 may rest. With this structure, the ball can be caught in the cup portion of the scoop and allowed to settle against the coupling section 210 of the scoop in the described pocket area. When it is desired to throw the ball, the scoop may be held in a generally horizontal position facing upwardly and then with a quick flip of the wrist, the ball will move upwardly in the scoop and then out of the scoop in the direction in which the player's wrist is flipped.

Figure 5:
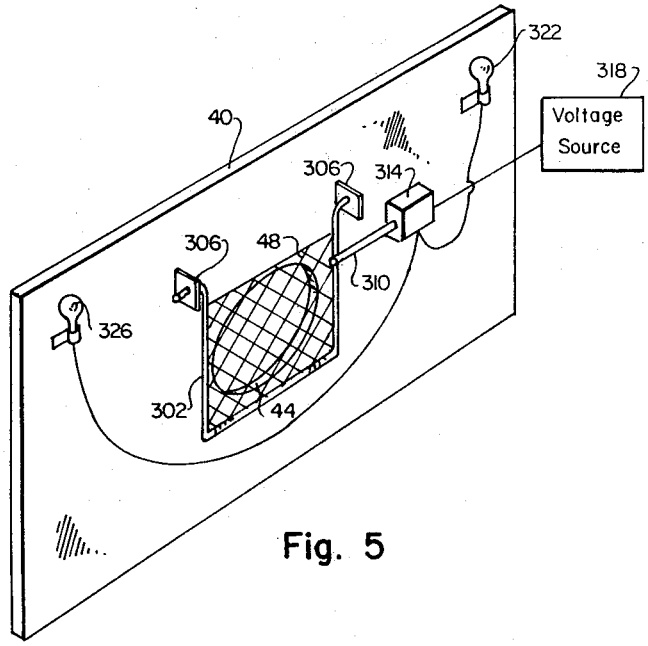
FIG. 5 is a rear, perspective view of a target of the apparatus of FIG. 1.

FIG. 5 shows a rear, perspective view of one illustrative embodiment of a target which may be utilized in the present game. The target includes a backboard 40 made of a flat, transparent sheet of material (such as plexiglass), an opening 44 centrally located in the backboard, and netting material 48 positioned behind the opening. The opening 44 is circular and is large enough to allow passage therethrough of at least a portion of the game ball. The netting can simply be a string material stretched on a generally U-shaped wire frame 302 which, in turn, is mounted to pivot in brackets 306. The brackets 306 are attached to the back of the backboard 40. The upper ends of the U-shaped wire frame 52 are bent to be generally colinear and to be inserted in openings in the brackets 306 so that the bottom part of the wire frame will pivot rearwardly of the backboard 40 when the netting material 48 is struck by a ball thrown through the opening 44.

As the wire frame 302 pivots rearwardly, it contacts a finger element 310 which extends from a switch 314 mounted to the backboard 40. When the finger element 310 is contacted and moved, it causes the switch 314 to close and thereby connect a voltage source 318 to lightbulbs 322 and 326 mounted on the back of the backboard 40. The lightbulbs are thereby caused to temporarily light to indicate that the target had been struck by a ball and a point or points scored. The switch 314 is simply a conventional normally open switch and is caused to close when the finger element 310 is deflected. Alternatively, the switch 314 could be used to couple the voltage source 318 to an audible alarm to audibly indicate that the target has been struck.

An exemplary set of rules for playing the game will now be described. The game may be played by teams having one or more players, depending upon the size of the playing floor 4, with target 32 (FIG. 1) being used by one team to score points and target 36 being used by the other team. Play is initiated by an official sitting in the official's stand 52 throwing the ball onto the playing floor 4 where each team attempts to gain possession of the ball. When a player gains possession, using only his scoop to seize the ball, he attempts to maneuver toward his team's target by driving his vehicle and/or passing the ball to other team members. The object of the game is to throw the ball through the opening in the target to score a goal or points. Throwing the ball may be done from any part of the floor but, of course, the closer a player is to his target, the more likely he is to throw the ball through the opening to strike the netting material.

When a team strikes the target and thereby scores a goal, the opposite team is given possession of the ball and it then attempts to maneuver down the floor toward its target to thereby attempt to score a goal. Defensive maneuvers of the game may consist of blocking the pathway of the opposite team member's vehicles, without intentionally striking the vehicles, and blocking attempted "shots" at the target.

There are two ways to acquire points, one being by striking the target, and the other being by the opposing team being assessed penalty points. Penalty points are awarded to a team when the other team commits a head-on collision, a rear-end collision, body contact with an opposing team player, and touching the ball with the hands. The official positioned in the official's stand 52 makes the judgment as to when penalty points should be awarded. A conventional type of scoreboard similar to a basketball scoreboard may be used to keep track of the points of each team.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. Ball game apparatus comprising a generally horizontally disposed playing floor having first and second oppositely located ends, at least two self-propelled vehicles for operating on the playing floor by at least two players of opposite teams, each vehicle including a frame having a front end, one or more wheels mounted to support the front end of the frame and to contact and roll along the playing floor, said one or more wheels being pivotable about a generally vertical axis to guide the vehicle, and crank means rotatably mounted in the frame and coupled to said one or more wheels to cause the wheel to pivot as the crank means is rotated, said crank means including a handle for grasping by one hand of a player to rotate the crank means, first and second target means positioned above the playing floor at the first and second ends thereof respectively, each target means including a generally flat, rigid sheet of material having an opening located therein, said opening being large enough to allow passage of at least a portion of a ball therethrough, said sheet of material being mounted above and generally perpendicularly to the floor at a respective end thereof, a target element positioned behind the opening in the sheet of material so that the target element is contacted when at least a portion of a ball passes through the opening, and means for producing a visual or audible signal, or both, in respose to the target element being contacted by a ball, at least two scoop means for use by at least two corresponding players for catching and throwing a ball, each scoop means including a handle portion by which the scoop means may be held, and a cup portion for receiving and holding a ball, and from which a ball may be thrown, and a ball for use by players in attempting to hit the targets to thereby score points.

2. Apparatus as in claim 1 wherein said playing floor is generally rectangular.

3. Apparatus as in claim 1 wherein the playing floor is about eighty feet in length and fifty feet in width.

4. Apparatus as in claim 1 further including walls for surrounding the playing floor and a ceiling for enclosing the playing floor.

5. Apparatus as in claim 4 further including resilient bumper guards disposed above the level of the playing floor and circumscribing the floor to prevent the vehicle from striking the walls.

6. Apparatus as in claim 1 further including a platform positioned at one side of and above the playing floor for supporting a referee.

7. Apparatus as in claim 1 wherein said one or more wheels is pivotable through 360 degrees.

8. Apparatus as in claim 7 wherein the crank means is coupled to the one or more wheels so that for each rotation of the crank means, said one or more wheels rotates one or less rotations.

9. Apparatus as in claim 1 wherein the crank means is positioned in front of the player supporting means of the vehicle, and spaced therefrom.

10. Apparatus as in claim 1 wherein each of said vehicles further includes a resilient guard means circumscribing the vehicle's frame to contact other vehicles and thereby prevent other vehicles from contacting the frame.

11. Apparatus as in claim 1 wherein said sheet of material is generally transparent, and wherein said producing means includes a lamp positioned behind the sheet of material which is lighted when the target element is contacted by a ball.

12. Apparatus as in claim 1 wherein said target element includes a wire frame mounted on the rear of the sheet of material behind the opening to pivot away from the sheet, and netting material stretched across the frame behind the opening to be contacted by a ball thrown at the opening to thereby cause the frame to pivot rearwardly and wherein said producing means includes a switch which is operated when the frame is pivoted away from the sheet of material, and a visual or audible means which is activated when the switch is operated.

13. Apparatus as in claim 12 wherein said wire frame is mounted to depend from a pivot location above the opening so that when the netting is contacted by a ball, the frame swings rearwardly, and wherein said switch includes a finger element extending behind a part of the wire frame to be moved thereby when the wire frame swings rearwardly, said switch being operated when the finger element is moved.

14. Apparatus as in claim 1 wherein said ball is constructed of a spherical shell made of a resilient material and having a plurality of openings therein.

* * * * *

UNITED STATES PATENT AND TRADEMARK OFFICE

CERTIFICATE OF CORRECTION

PATENT NO. : 4,387,898

DATED : June 14, 1983

INVENTOR(S) : U. Stancel Mangum and Kim S. Mangum

It is certified that error appears in the above-identified patent and that said Letters Patent is hereby corrected as shown below:

On the title page item [76] should read as follows:

--U. Stancel Mangum, 838 E. 6600
South, Murray, Utah 84107
Kim S. Mangum, 5714 South 1050 East,
Salt Lake City, Utah 84121--.

Signed and Sealed this

*Twelfth* Day of *June 1984*

[SEAL]

*Attest:*

GERALD J. MOSSINGHOFF

*Attesting Officer*

*Commissioner of Patents and Trademarks*